United States Patent [19]

Dawson et al.

[11] 3,941,713

[45] Mar. 2, 1976

[54] RINSE COMPOSITION

[75] Inventors: Peter Leonard Dawson, Chester, England; Michael David Rickard, Deeside, Wales; Michael Tom Rothwell, Bromborough, England

[73] Assignee: Lever Brothers Company, New York, N.Y.

[22] Filed: Oct. 1, 1973

[21] Appl. No.: 402,428

[30] Foreign Application Priority Data

Oct. 4, 1972 United Kingdom ..... 45680/72

[52] U.S. Cl. ..... 252/142; 106/2; 252/82; 252/89 R; 427/156

[51] Int. Cl.[2] ..... C02B 5/06

[58] Field of Search ..... 106/2; 252/89, 82, 142, 252/DIG. 17; 427/156

[56] References Cited

UNITED STATES PATENTS

| | | | |
|---|---|---|---|
| 3,563,901 | 2/1971 | Crotty | 252/136 |
| 3,592,774 | 7/1971 | Altensdropfer | 252/170 |
| 3,629,127 | 12/1971 | Palmer | 252/89 |

*Primary Examiner*—Lorenzo B. Hayes
*Attorney, Agent, or Firm*—Arnold Grant

[57] ABSTRACT

A machine dishwasher rinse aid having the property of imparting an anti-resoiling or non-stick finish to aluminium articles such as pans. The rinse aid contains an anti-resoiling agent which is preferably a monoalkylphosphate ester to achieve this effect. It also contains a nonionic surface active agent and a pH controller in the form of citric, lactic or glutaric acid.

5 Claims, No Drawings

RINSE COMPOSITION

The present invention relates to a liquid rinse composition for use in machine dishwashing which contains an anti-resoiling agent for imparting a non-stick effect to aluminium articles rinsed with the composition.

British Pat. No. 1,188,577 relates to rinse aids for machine dishwashers and discloses, in Example 1, a rinse aid which contains an anionic surfactant which is described quite generally as an aliphatic phosphate ester.

We have discovered that aliphatic phosphate esters and also other materials defined hereafter can be incorporated into a rinse composition base of a special type so that an anti-resoiling effect on aluminium surfaces can be achieved in a wide range of waters of different hardnesses.

Accordingly the present invention provides a liquid rinse composition for use in machine dishwashing comprising:

a. a low foaming nonionic surface active agent
b. an anti-resoiling agent as herein defined and
c. from 35–80% by weight of lactic, citric or glutaric acid or a mixture thereof.

The composition has the usual and essential attributes of the products well known as "rinse aids", viz no or low foam, wettability of crockery and glassware without damage thereto, ready solubility in the rinse water, pleasant odour, and avoidance of spotting, filming and streaking of articles rinsed thereby in the rinse cycle of a machine dishwasher. The present rinse composition has the further attributes of phase stability and chemical stability when stored on the shelf, and, more importantly, when stored in the reservoir of the machine. It will be appreciated that the reservoir in some machine designs is subjected to the effect of the temperature used in the washing and rinsing cycles, and that the rinse composition present in the machine reservoir can vary in temperature from room temperature to about 40°C.

The compositions may be applied in the final rinse cycle of the dishwashing programme to (a) pans which have just been washed clean in an immediately preceding dishwashing cycle, (b) pans cleaned manually, or (c) new pans. As pans are the usual aluminium surfaces met with in machine dishwashing, the specification will illustrate the invention therewith, but it will be understood that any cleaned aluminium surface to which a machine dishwashing rinse cycle can be applied, can be treated by the rinse compositions of the invention. Generally, the final rinse cycle into which the rinse composition is injected, is programmed at a temperature of at least 60°C, sometimes up to 70°C, and extends for at least 3 minutes, sometimes up to 10 minutes, and is accompanied by agitation or spinning. The rinse compositions of the present invention are intended to confer the anti-resoiling effect to substantially clean aluminium surfaces under the above conditions.

The anti-resoiling effect is the effect by which a temporary film is laid upon the aluminium surface during the rinse cycle which inhibits subsequent soil from attaching itself firmly to the surface. Any subsequent soil is readily removable in a later dishwashing cycle.

The anti-resoiling agent is an agent which satisfies the following test.

The inside surface of a small 5 inch diameter aluminium pan is prepared by scouring the warm tap water with a non-woven nylon fleece impregnated with mineral abrasive until the surface is completely wetted by the water. The pan is then dried with a paper tissue. 25 ml of an egg/milk mixture of ratio 50:50 by volume is poured into the pan in the usual way. The mixture is cooked for 1½ minutes on an electric hot plate maintained at 200°C without stirring. Under these conditions the egg/milk mixture leaves the coherent light brown residue adhering to the pan when the loose bulk of the cooked mixture has been scraped out with a wooden spoon. This soiled pan is immersed in a solution of 0.01% material being assessed as an anti-resoiling agent in distilled water at pH 5 and manually scoured with the above-mentioned abrasive fleece for 60 seconds, during which all the burnt soil is removed. The pan is rinsed in tap water and dried with a paper tissue.

The cooking procedure with the egg/milk mixture is repeated after which the soiled pan freed of the loose bulk of soil is immersed in the same (used) solution as above for 30 seconds. A soft polyurethane sponge is then used manually to remove the adhering residue. If the pan is completely clean after 15 seconds rubbing the test is terminated and a score of 1 wash/cook cycle recorded. If the soil cannot be totally removed with the sponge in 15 seconds a further 15 seconds scouring with the above abrasive fleece is carried out. The pan is then rinsed and dried as before and subjected to the above egg/milk cooking procedure. The soiled pan freed of the loose bulk of soil is immersed in the same (used) solution for 30 seconds. If the soil can be removed in 15 seconds with the soft sponge a score of 2 wash/cook cycles is recorded. If not the test is repeated until the 15 seconds clean is obtained.

An anti-resoiling agent is one in which complete removal of soil residues can be attained with a soft sponge in 15 seconds in 3 or fewer wash/cook cycles.

Whilst the selection of the nonionic surface active agent is in accordance with usual rinse aid technology, careful selection of the anti-resoiling agent and the pH controller is necessary in order to maintain the properties required of a conventional rinse aid described above whilst providing an anti-resoiling effect in the rinse cycle.

The low foaming, nonionic surface active agent may be selected from, for example, i. polyoxyethylene-polyoxypropylene-polyoxyethylene polyols;

ii. polyoxyethylene-polyoxypropylene condensates of higher aliphatic alcohols having from 8–22 carbon atoms in the aliphatic portion and 3–50 oxyalkylene units in the oxyalkylene portion;

iii. polyoxyethylene esters of higher fatty acids having from 8–22 carbon atoms in the acyl group and from 8–30 ethylene oxide units in the oxyethylene portion; and iv. polyoxyethylene condensates of higher fatty acid amines and amides having 8–22 carbon atoms in the fatty alkyl or acyl group and 10–30 ethylene oxide units in the oxyethylene portion.

When selecting the nonionic surface active agent, choice is on the basis of good biodegradability, and cloud point less than 60°C (this is the normal use temperature of the rinse solution). It will be appreciated that these surface active agents produce minimum foam in solution when the temperature of the solution is greater than the cloud point of the agent.

The monoalkylphosphate ester as preferred antiresoiling agent is selected from:

1. Mono-substituted organic phosphates of the general formula:

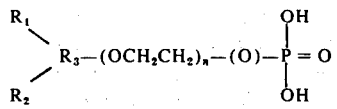

wherein $n$ is the actual number of ethylene oxide units, i.e., not the average number, and is 0–5; $R_1$ and $R_2$ are hydrocarbon chains where $R_1$ is $-(CH_2)_xCH_3$ or $-(CH_2)_xC_6H_5$, $R_2$ is $-(CH_2)_yCH_3$ or $-(CH_2)_yC_6H_5$, and $R_3$ is one of $>CH-(CH_2)_z-$
$>CH-(CH_2)_z-C_6H_4-$
$>C_6H_3-(CH_2)_z-$ $-CH.(CH_2)_z-$
$|$
$-CHOH$ $x$, $y$ or $z$ may be zero. $x+y+z$ total 7–17 (inclusive) when alkyl hydrocarbon organic groups are employed in $R_1$, $R_2$ or $R_3$; $x+y+z$ total 6–16 (inclusive) when aryl or hydroxyalkyl organic groups are employed in $R_3$.

2. Mono-substituted organic phosphates of the general formula:

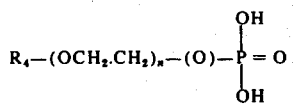

wherein $n$ is the actual number of ethylene oxide units and $R_4$ is a linear alkyl hydrocarbon chain. When $n$ is 0, $R_4$ may have 10–16 carbon atoms and when $n$ is 1–5 $R_4$ may have 10–18 carbon atoms.

3. The reaction product of the commercially available alcohols which contain a mixture of linear and branched alcohols, (particularly those made from the catalytic addition of carbon monoxide and hydrogen to an alpha-olefin) with phosphorus pentoxide ($P_2O_5$) in the correct proportions to produce substantially monoalkylphosphate esters.

The preferred phosphates from 1. above are those wherein $x+y+z$ total 9–13 when alkyl groups are concerned and 6 or 14–16 when aryl or hydroxyalkyl groups are concerned. The phosphates of formula 1. are preferred because at least two terminal groups $R_1$ and $R_2$ are essential for the property of anti-resoiling in the rinse cycle carried out in all naturally occurring waters. They are used, preferably, in their mono salt form, i.e. sodium, potassium, ammonium or substituted ammonium. Although compounds having more than two terminal groups can be used successfully, they are not recommended because they may cause biodegradation problems.

Other preferred phosphates from formula 1. are the phosphate monoesters of:

a. an adduct of p-tertiary nonyl phenol and an average of 2 or 4 ethylene oxide molecules per mol of phenol, b. an adduct of ditertiary nonyl phenol and an average of 8 ethylene oxide molecules per mol of phenol,
c. $C_{11}$-$C_{15}$ random secondary alcohols,
d. an adduct of $C_{11}$-$C_{15}$ random secondary alcohols and an average of 3 ethylene oxide units per molecule,
e. an adduct of $C_{13}$-$C_{15}$ random secondary alcohols and an average of 1 ethylene oxide unit per molecule,
f. 7-ethyl 2-methyl, 4 undecanol,
g. $C_{14\text{-}16}$ random vicinal diols,
h. an adduct of $C_{14\text{-}16}$ random vicinal diols and an average of 3 ethylene oxide molecules per mol of diol.

The phosphates of formula 2 are successful in distilled or soft water, but precipitate at all pH's in hard water. This precipitate is detrimental to the anti-resoiling property. Furthermore, it may lead to a high incidence of deposits on glassware seen as "spotting," undesirable in a composition which is intended to have the properties usual in a rinse aid.

A preferred formula 2 phosphate is lauryl phosphate where $R_4$ is $C_{12}H_{25}$ and $n=0$. Compounds of formula 2 where R is greater than 16 and $n$ is zero are unsuitable, because of phase instability in use.

The preferred phosphates of formula 3 for use in all naturally occurring waters, have at least 30% of the mixture as a phosphate according to formula 1 above.

A preferred example of formula 3 is a mixture of formula 1:

$R_1 = CH_3(CH_2)_9$ and $CH_3(CH_2)_{11}$
$R_2 = CH_3$, $C_2H_5$
$R_3 = >CHCH_2-$ and $n = 3$ (average) 0–5 actual.

and formula 2:

$R_4$ is $C_{13}H_{27}$ and $C_{15}H_{31}$ and $n = 3$ (average) 0–5 actual.

The mixture has approximately 33% of hydrocarbon chains having 15 carbon atoms, and approximately 67% of hydrocarbon chains having 13 carbon atoms. The mixture has approximately 45% of compounds according to formula 2 and approximately 55% of compounds according to formula 1.

The function of the pH controller in the rinse composition is to reduce the effect of water hardness ions such as $Ca^{++}$ and $Mg^{++}$ on the anti-resoiling ability of the selected mono alkyl phosphate ester. At pH values above approximately 6.5 in aqueous solution all monoalkyl phosphate esters form insoluble precipitates when added to naturally occurring hard water. The formation of this precipitate prevents the mono alkyl phosphate ester from forming an anti-resoiling film on the surface of aluminium cooking utensils and in addition the precipitate may cause excessive "spotting" on glassware being rinsed in a solution of the composition. The pH controller which is acidic must be present in type, and in amount, so as to ensure that the pH of the rinse solution is sufficiently low to prevent the formation of undesirable precipitates. The composition of the rinse composition must be such that sufficient pH controller is provided to overcome the buffering capacity of naturally occurring water, due to the presence of bicarbonate ions and dissolved carbon dioxide.

The majority of dishwashing machines currently sold are provided with (i) an automatic device for dosing up to 6 mls rinse aid per cycle at the required stage of the overall wash cycle, and (ii) a programme which gives a reasonable time (up to 10 minutes) for the rinse cycle.

The rinse composition is dosed into 8–10 liters of water, to form the rinse solution. The rinse solution also may contain some carry-over of alkaline liquor from the main wash cycle.

Consequently, a commercially useful rinse composition for effecting an anti-resoiling finish in the rinse cycle must contain enough acidity in order that a dilution, such as, for example, that described above, will ensure a rinse solution pH of less than pH 6.5, preferably 5.0 to 5.5, when diluted in a range of different machine dishwashers using a wide range of naturally occurring waters.

The rinse compositions of the invention, as marketed, are formulated to a pH of 2–3, neutralising the acid where necessary. 0.880 ammonia is a suitable material for this neutralisation. The pH of 2–3 is the optimum balance between maximum reserve hydrogen ion and minimum corrosive attack on the material of the dosage chamber and any sensitive substrate in direct alignment into the injection path of the rinse composition in the machine.

For practical purposes, as explained above, the pH controller is selected on the basis that a 6 ml dose of rinse composition per 9–10 liters of 24°H water should give a rinse solution pH of less than 6.5. That is at a solution of approximately 6 mls in 9000 mls, i.e. 0.067% of rinse composition by weight of the rinse solution present in the rinse cycle.

Selection of a suitable acid, which will not impair the chemical and phase stabilities of the rinse composition, nor impair the rinse aid properties, whilst attaining the pH in use now found to be essential for anti-resoiling effect in all waters is difficult. Any slight phase instability can be dealt with by inclusion of up to 15% isopropanol. In general, the acid strength is dependent upon the type of acid viz. molecular weight, pKa and number of labile hydrogen atoms. The stability of the rinse composition at the pH of 2–3 is assessed visually after 6 cycles from room temperature to 40°C, the composition being homogeneous at 40°C.

In the rinse compositions of the present invention, the pH controller is selected from lactic acid, citric acid and glutaric acid. Acids such as phosphoric, maleic, acetic, malic, oxalic, malonic, succinic, fumaric, formic, adipic and mixtures thereof are unsuitable. The preferred acid is lactic acid.

The rinse compositions of the invention are for use on substantially clean aluminium surfaces. It will be appreciated that some dishwashing machines are not very effective in removing certain difficult soils such as heat degraded soup, scrambled eggs and porridge from cooking utensils. This is particularly true where only a little manual cleaning is done before loading the soiled utensil into the machine.

The rinse compositions are therefore preferably used on a clean aluminium pan before use of the pan for cooking. The rinse cycle or a process equivalent thereto is a suitable means of obtaining the anti-resoiling effect, so to render all subsequent soils readily removable in all machines. This pretreatment can be affected simply by placing the pan in the normal load of dirty crockery etc. and subjecting the load plus pan to the conventional full wash and rinse programme, using the rinse composition of the invention in the rinse cycle. This pretreatment may also be sufficient with lightly soiled pans washed in this manner. The surface modification effected by the rinse composition of the invention on a clean pan is therefore of great value in assisting in the clean washing of such pans when heavily soiled subsequently, in all machines. Once the temporary film is upon the surface, soils are readily removed in the main washing cycle. The temporary film is maintained on the surface during subsequent rinse cycles by the rinse composition of the invention.

The rinse composition as marketed contains by weight of composition 3–30% of low foaming nonionic surface active agent, preferably 4–10%; 0.5–10% of defined anti-resoiling agent, preferably 2–6%, 35–80% of the pH controller, preferably at least 50%. A preferred composition provides an average in-use concentration by weight of rinse solution of 0.0035% low foaming nonionic surface active agent, 0.002% anti-resoiling agent, and 0.05% pH controller. It will be appreciated that when a monoalkyl phosphate ester is used as the anti-resoiling agent, commercial supplies of monoalkyl phosphate ester contains substantial quantities of di-alkyl phosphate ester, some trialkyl phosphate ester, unphosphated alcohol and phosphoric acid. The figures quoted in respect of the commercial ester refer to the monoalkyl phosphate ester content of the rinse composition.

The use of monoalkyl phosphates in the main wash cycle of a machine dishwasher is not practical because the main wash cycle is normally carried out with a strongly alkaline liquor and under these conditions the monoalkyl phosphate is readily precipitated by any divalent metal ions present in solution e.g. calcium and magnesium ions. Its interaction with aluminium to provide and anti-resoiling effect is therefore impaired. The anti-resoiling effect is also impaired in aqueous solution by the presence of high levels of condensed phosphates such as those often present in machine dishwashing powders.

The rinse compositions of the invention will now be described by way of Examples. Examples 1–16 employed a Hoover Autojet (Registererd Trade Mark) machine and its programme is given below for completeness and convenience. The ° hardness are on the French scale (parts per 100,000 as calcium carbonate).

A Hoover Autojet (RTM) machine dishwasher was used. This has the wash programme as follows:

| | Duration | Vol of $H_2O$ | Temperature of $H_2O$ | Agitation |
|---|---|---|---|---|
| Pre-rinse | 2 mins | 8.5 litres | 20°C | Yes |
| Main wash | 23 mins | 8.5 litres | 20°C–63°C in 10 mins. Maintained to end of wash. | Yes |
| Intermediate rinse (1) | 1½ mins | 8.5 litres | 20°C | Yes |
| Intermediate rinse (2) | 1½ mins | 8.5 litres | 20°C | Yes |
| Final rinse | | | | |
| Heat: | 12 mins | 8.5 litres | 20°C–60°C | No |
| Spin: | 12 mins | 8.5 litres | 60°C | Yes |
| Empty | ½ min | 8.5 litres | 60°C | No |

30 gms of a commercial dishwashing powder were dosed manually, i.e. "over the side" after 8 minutes operation of the main wash cycle. (The dosage is normally mechanical, by way of the temperature sensitised dosing device found to operate at 40°C ± 2°C, a temperature reached in about 8 mins from starting with tape water.)

The rinse composition was dosed "over the side" in the amount specified, after 1 min of the "final rinse-spin" cycle, the water for the rinse solution being at 60°C.

EXAMPLE 1

A rinse composition of the present invention consisting of: 67.5% lactic acid, 3.5% monoalkyl phosphate ester of $C_{11-15}$ random sec. alcohol with an average of 3 ethylene oxide mols per mol of alcohol, 5% Plurafac RA40 (RTM), (commercially available from Wyandotte, a low foaming nonionic surface active agent of type (ii) above described), 15% isopropanol, the balance water and neutralised with ammonia to pH 2.5 established as its anti-resoiling effect as follows:

12 abraded aluminium plates measuring 6 inches × 6 inches by 1/16 inch were divided into two groups of six. Pretreatment. One group of six was subjected to the full wash and rinse programme of the Hoover Autojet (RTM) using a 6 ml dose of the rinse composition. The other six plates were washed in the same way, but using a 6 ml dose of a rinse aid (A) as control. Rinse aid (A) consisted of 30% Plurafac RA40, 0.5% isopropanol and 69.5% water. After this wash and rinse programme the 12 plates were soiled with egg by spreading 3 mls of beaten raw egg on each plate and heating for 2 minutes on a hot plate at 230°C. They were then subjected to the full wash rinse programme in two groups of six in each group; each six consisting of three of the plates treated with the rinse composition of the invention and three of the plates treated with rinse aid (A). One group was washed in 24°H water using a 6 ml dose of the rinse composition of the invention and the other group was washed in 24°H water using a 6 ml dose of rinse aid (A). The plates were arranged in the machine such that they were fully exposed to the water jets. On completion of the full wash and rinse programme the plates were assessed visually for cleanliness and ranked on a scale from 1–4 based on the area of soiling remaining on the plates, 1 being completely clean and 4 being visually unchanged.

| Set | Pretreatment Rinse agent | Rinse agent in wash/rinsing of soiled Al plates | Anti-resoiling assessment | | |
|---|---|---|---|---|---|
| 1 | According to invention | According to invention | 1, | 1, | 1 |
| 2 | (A) | According to invention | 3, | 4, | 4 |
| 3 | According to invention | (A) | 1, | 1, | 1 |
| 4 | (A) | (A) | 4, | 4, | 4 |

These results clearly demonstrate the anti-resoiling effect of the composition according to the invention. The composition possesses the usual attributes of a rinse aid and is phase stable.

| Example No. | 2 | 3 | 4 |
|---|---|---|---|
| Lactic acid | 70 | 65 | 50 |
| Monoalkyl phosphate ester | 1.0* | 10+ | 5* |
| Nonionic surface active agent | I 10 | II 10 | III 10 |
| Isopropanol | 10 | 10 | 5 |
| Water | balance | balance | balance |
| 0.880 ammonia to pH | (2.5) | (2.5) | (2.5) |

The test was as for Example 1 for compositions 2 and 3; results all scored 1 using compositions of Examples 2, 3 and 4, and 4 when using rinse aid A. Composition 4 was checked in 6°H water.

+=of dinonyl phenol-8EO

*=of a mixture containing approximately 67% $C_{12}$ and 33% $C_{15}$ nominally linear aliphatic alcohols containing approximately 55% alpha-methyl and alpha-ethyl branching, condensed with an average of 3 ethylene oxide mols per mol of alcohol I=Triton DS 16 ex Rohm & Haas and believed to be class (ii)

II=a polyoxyethylene ester of a higher fatty acid of class (iii)

III=of class (iv)

Example 4 is satisfactory in soft water.

EXAMPLES 5–15

These examples demonstrate the necessity to provide pH control in order to obtain satisfactory anti-resoiling performance, in waters commonly encountered.

The tests were done using clean, abraded, aluminium plates pretreated in the rinse cycle of the Hoover Autojet (RTM) as described in Example 1, with the specified dose of rinse compositions consisting of, according to Example 1, with modified acid component and pH level.

These pretreated plates together with untreated control plates were soiled, washed and assessed as described in Example 1, the assessment being done at the end of the main wash cycle, for practical convenience, because this is the earliest point at which the degree of soil removal can be assessed. The abbreviation IC means Inoperative Conditions.

| Ex | Composition | | Dose | In-use pH | | | Anti-resoiling assessment 24°H | | 6°H | | 0°H | |
|---|---|---|---|---|---|---|---|---|---|---|---|---|
| No | Acid content | pH | Mls | 24°H | 6°H | 0°H | treated | untreated | treated | untreated | treated | untreated |
| 5 | 40% | to pH 2.5 | 6 | 6.6 | — | — | 2 | 4 | — | — | — | — |
| | citric acid | | 3 | — | — | 3.5 | — | — | — | — | 1 | 4 |
| | | | 5 | 7.7 | — | — | 4 | 4 | — | — | — | — |
| IC | | | 4 | 7.8 | — | — | 4 | 4 | — | — | — | — |
| | | | 3 | 7.8 | — | — | 4 | 4 | — | — | — | — |
| 6 | 50% | to pH 2.5 | 6 | 5.0 | — | — | 1 | 4 | — | — | — | — |
| | citric acid | | 3 | — | — | 3.6 | — | — | — | — | 1 | 4 |
| | | | 5 | 6.2 | — | — | 2 | 4 | — | — | — | — |
| | | | 4 | 8.0 | — | — | 4 | 4 | — | — | — | — |
| IC | | | 3 | 8.0 | — | — | 4 | 4 | — | — | — | — |
| 7 | 50% | to pH 3.0 | 6 | 5.0 | — | — | 1 | 4 | — | — | — | — |
| | citric acid | | 5 | 6.0 | — | — | 1 | 4 | — | — | — | — |
| | | | 4 | 7.8 | — | — | 4 | 4 | — | — | — | — |
| IC | | | 3 | 8.0 | — | — | 4 | 4 | — | — | — | — |
| 8 | 50% | to pH 3.5 | 6 | 5.7 | — | — | 1 | 4 | — | — | — | — |
| | citric acid | | 3 | — | — | 3.6 | | | | — | 1 | 4 |
| | | | 5 | 8.0 | — | — | 4 | 4 | — | | | |
| IC | | | 4 | 8.0 | — | — | 4 | 4 | — | — | — | — |
| | | | 3 | 7.9 | — | — | 4 | 4 | | | — | — |

-continued

| Ex No | Composition Acid content | pH | Dose Mls | In-use pH 24°H | 6°H | 0°H | Anti-resoiling assessment 24°H treated | untreated | 6°H treated | untreated | 0°H treated | untreated |
|---|---|---|---|---|---|---|---|---|---|---|---|---|
| 9 | 45% of lactic acid | to pH 2.5 | 6 | — | 3.8 | — | | | 1 | 4 | — | — |
| | | | 5 | — | 4.0 | — | — | — | 1 | 4 | — | — |
| | | | 4 | — | 4.3 | — | — | — | 1 | 4 | — | — |
| | | | 3 | — | 6.4 | 3.4 | — | — | 1 | 4 | 1 | 4 |
| IC | | | 6 | 7.5 | — | — | 4 | 4 | — | — | — | — |
| 10 | 54% of lactic acid | to pH 2.5 | 6 | 6.6 | 3.7 | — | 2 | 4 | 1 | 4 | — | — |
| | | | 5 | — | 3.8 | — | — | — | 1 | 4 | — | — |
| | | | 4 | — | 4.0 | — | — | — | 1 | 4 | — | — |
| | | | 3 | — | 4.3 | 3.5 | — | — | 1 | 4 | 1 | 4 |
| IC | | | 5 | 8.0 | — | — | 4 | 4 | — | — | — | — |
| | | | 4 | 7.8 | — | — | 4 | 4 | — | — | — | — |
| | | | 3 | 7.9 | — | — | 4 | 4 | — | — | — | — |
| 11 | 58.5% of lactic acid | to pH 2.5 | 6 | 5.5 | — | — | 1 | 4 | — | — | — | — |
| | | | 5 | 6.5 | — | — | 2 | 4 | — | — | — | — |
| | | | 3 | — | — | 3.3 | — | — | — | — | 1 | 4 |
| IC | | | 4 | 7.8 | — | — | 4 | 4 | — | — | — | — |
| | | | 3 | 8.0 | — | — | 4 | 4 | | | — | — |
| 12 | 63% of lactic acid | to pH 2.5 | 6 | 4.8 | 3.5 | — | 1 | 4 | 1 | 4 | — | — |
| | | | 5 | 6.3 | 3.6 | — | 2 | 4 | 1 | 4 | — | — |
| | | | 4 | | 3.8 | — | — | — | 1 | 4 | — | — |
| | | | 3 | | 4.1 | 3.3 | — | — | 1 | 4 | 1 | 4 |
| IC | | | 4 | 7.9 | — | — | 4 | 4 | — | — | — | — |
| | | | 3 | 8.0 | — | — | 4 | 4 | — | — | — | — |
| 13 | 67.5% of lactic acid | to pH 2.5 | 6 | 4.5 | 3.5 | | 1 | 4 | 1 | 4 | — | — |
| | | | 5 | 4.6 | 3.6 | | 1 | 4 | 1 | 4 | — | — |
| | | | 4 | — | 3.7 | | — | — | 1 | 4 | — | — |
| | | | 3 | — | 3.9 | 3.3 | — | — | 1 | 4 | 1 | 4 |
| IC | | | 4 | 7.5 | — | — | 4 | 4 | — | — | — | — |
| | | | 3 | 8.0 | — | — | 4 | 4 | — | — | — | — |
| 14 | 67.5% lactic acid | to pH 3.0 | 6 | 4.65 | — | — | 1 | 4 | — | — | — | — |
| IC | | | 5 | 7.0 | — | — | 4 | 4 | — | — | — | — |
| | | | 4 | 7.8 | — | — | 4 | 4 | — | — | — | — |
| | | | 3 | 8.0 | — | — | 4 | 4 | — | — | — | — |
| 15 | 67.5% lactic acid | to pH 3.5 | 6 | 6.6 | — | — | 2–3 | 4 | — | — | — | — |
| | | | 3 | — | 3.4 | — | — | — | 1 | 4 | — | — |
| IC | | | 5 | 7.2 | — | — | 4 | 4 | — | — | — | — |
| | | | 4 | 7.0 | — | — | 4 | 4 | — | — | — | — |
| | | | 3 | 7.6 | — | — | 4 | 4 | — | — | — | — |

EXAMPLES 16–19

Rinse compositions according to the Example 1, modified by amount of phosphate ester. They possessed the usual rinse aid properties and were chemically and physically stable.

The Comparative compositions, rinse aids (B) and (C), excluded the monoalkyl phosphate ester.

| Ex No | % monoalkyl phosphate ester | Dose Mls | pH of rinse solution 24°H | 0°H | Anti-resoiling assessment 24°H | 0°H |
|---|---|---|---|---|---|---|
| 16 | 3.5 | 6 | 4.5 | 3.1 | 1 | 1 |
| 17 | 0.75 | 6 | 4.6 | 3.1 | 2 | 1 |
| 18 | 3.5 | 3 | — | 3.3 | — | 1 |
| 19 | 0.75 | 3 | — | 3.4 | — | 2 |
| (B) | 0 | 6 | 4.5 | — | 4 | — |
| (C) | 0 | 3 | — | 3.3 | — | 4 |

EXAMPLES 20–23

These examples demonstrate the use of the rinse composition of the invention in machines other than the Hoover Autojet (RTM). These tests were carried out using aluminium pans soiled in the way described in Example 1 for the plates. The pans were pretreated before soiling using either the rinse composition of Example 1 or, as control, the rinse aid (A) described in Example 1. Only the rinse cycle of the machines were used at a 6 ml does of the rinse composition/aid. All the pans were washed together with a load of soiled glassware, in the machine specified in the table. The main wash detergent powder dose was 30 gms in all cases. Where possible the water softening device attached to the machines was by-passed. Results from pretreatment at a 3 ml dosage of rinse composition/aid bore out the effect of pH, since in these machines 3 ml dosage gives an in-use pH in excess of 6.5, and no antiresoiling effect is attained. Assessment of the glass for spotting and filming showed that the rinse composition of the invention was equivalent in performance to the control rinse aid.

| Ex No | Machine | Pretreatment Conditions Rinse agent Type | Mls | $H_2O$ °H | Final rinse time (mins) | Wash and rinse Conditions pH of main wash cycle | pH of rinse solution pre rinse agent | post rinse agent | Assessment Pretreated pan | Control pan |
|---|---|---|---|---|---|---|---|---|---|---|
| 20 | Bosch | Ex 1 | 6 | 32° | 3 | 10.9 | 8.5 | 4.3 | 1 | 4 |
| — | | A | 6 | 32° | 3 | 10.8 | 8.5 | 8.5 | 4 | 4 |
| 21 | Zanussi | Ex 1 | 6 | 32° | 3 | 10.9 | 8.4 | 4.35 | 1 | 4 |
| | SL12 | A | 6 | 32° | 3 | 10.8 | 8.35 | 8.2 | 4 | 4 |
| — | | | | | | | | | | |
| 22 | Miele | Ex 1 | 6 | 32° | 3 | 11.4 | 8.7 | 4.7 | 2 | 4 |
| | G500 | A | 6 | 32° | 3 | 11.4 | 8.7 | 8.5 | 4 | 4 |
| — | | | | | | | | | | |
| 23 | Indesit* | Ex 1 | 6 | 6° | 3 | 11.6 | 8.0 | 3.7 | 1 | 4 |
| — | | A | 6 | 6° | 3 | 11.6 | 8.0 | 8.1 | 4 | 4 |

*This machine was not equipped with a by-pass for the water softening unit.

What is claimed is:

1. A liquid rinse composition for use in machine dishwashing comprising a. from 3–30% by weight of a low foaming nonionic surface active agent selected from the group consisting of polyoxyethylene-polyoxypropylene-polyoxyethylene polyols; polyoxyethylene-polyoxypropylene condensates of higher aliphatic alcohols having from 8–22 carbon atoms in the aliphatic portion and from 3–50 oxyalkylene units in the oxyalkylene portion; polyoxyethylene esters of higher fatty acids having from 8–22 carbon atoms in the acyl group and from 8–30 ethylene oxide units in the oxyethylene portion; and polyoxyethylene condensates of higher fatty acid amines and amides having from 8–22 carbon atoms in the fatty alkyl or acyl group and from 10–30 ethylene oxide units in the oxyethylene portion;

b. from 0.5–10% by weight of a monoalkylphosphate ester selected from the group consisting of esters of the general formula

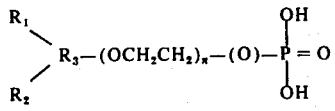

where $n$, the actual number of ethylene oxide units, is 0–5;

$R_1$ is $-(CH_2)_xCH_3$ or $-(CH_2)_xC_6H_5$;

$R_2$ is $-(CH_2)_yCH_3$ or $-(CH_2)_yC_6H_5$;

$R_3$ is $>CH\text{-}(CH_2)_z-$, $>CH-(CH_2)_z-C_6H_4-$, $>C_6H_3-(CH_2)_z-$, or $-CH.(CH_2)_z-$; $-CHOH$ and $x$,$y$ or $z$ are zero or integers such that $x + y + z$ are from 7 to 17 when $R_1$, $R_2$ or $R_3$ comprise alkyl hydrocarbon groups and 6 to 16 when $R_3$ comprises aryl or hydroxyalkyl groups; and mono-substituted organic phosphates of the general formula

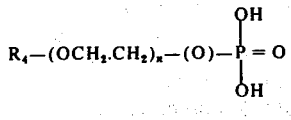

$n$ being the actual number of ethylene oxide units and $R_4$ a linear alkyl hydrocarbon chain wherein when $n$ is 0 $R_4$ is $C_{10\text{-}16}$ alkyl and when $n$ is from 1–5 $R_4$ is $C_{10\text{-}18}$ alkyl; and (c) from 35-80% by weight of lactic, citric or glutaric acid or a mixture thereof.

2. A rinse composition according to claim 1 wherein the monoalkylphosphate ester is an ester of a $C_{11\text{-}15}$ random secondary alcohol containing an average of 3 moles of ethylene oxide per mole of alcohol.

3. A rinse composition according to claim 1 comprising from 0–15% by weight of isopropanol.

4. A rinse composition according to claim 1 having a pH of from 2 to 3.

5. A method of providing an anti-resoiling film on the surface of aluminium articles which comprises rinsing the articles in a dilute solution of a rinse composition, said rinse comprising a. from 3–30% by weight of a low foaming surface active agent selected from the group consisting of polyoxyethylene-polyoxypropylene-polyoxyethylene polyols; polyoxyethylenepolyoxypropylene condensates of higher aliphatic alcohols having from 8–22 carbon atoms in the aliphatic portion and from 3–50 oxyalkylene units in the oxyalkylene portion; polyoxyethylene esters of higher fatty acids having from 8–22 carbon atoms in the acyl group and from 8–30 ethylene oxide units in the oxyethylene portion; and polyoxyethylene condensates of higher fatty acid amines and amides having from 8–22 carbon atoms in the fatty alkyl or acyl group and from 10–30 ethylene oxide units in the oxyethylene portion;

b. from 0.5–10% by weight of a monoalkylphosphate ester selected from the group consisting of esters of the general formula

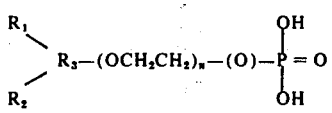

where $n$, the actual number of ethylene oxide units, is 0–5;

$R_1$ is $-(CH_2)_xCH_3$ or $-(CH_2)_x C_6H_5$;

$R_2$ is $-(CH_2)_yCH_3$ or $-(CH_2)_yC_6H_5$;

$R_3$ is $>CH-(CH_2)_z-$, $>CH-(CH_2)_z-C_6H_4-$, $>C_6H_3-(CH_2)_z-$, or $-CH.(CH_2)_z$ $CHOH$ and $x$, $y$ or $z$ are zero or integers such that $x + y + z$ are from 7 to 17 when $R_1$, $R_2$ or $R_3$ comprise alkyl hydrocarbon groups and 6 to 16 when $R_3$ comprises aryl or hydroxyalkyl groups; and mono-substituted organic phosphates of the general formula

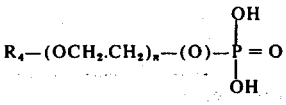

$n$ being the actual number of ethylene oxide units and $R_4$ a linear alkyl hydrocarbon chain wherein when $n$ is 0 $R_4$ is $C_{10\text{-}16}$ alkyl and when $n$ is from 1-5 $R_4$ is $C_{10\text{-}18}$ alkyl; and c. citric, lactic or glutaric acids or a mixture thereof in amount, being not less than 35 nor more than 80% by weight of said rinse composition, such that when 6 mls of said rinse composition is added to from 9–10 liters of water of 24° hardness the dilute solution obtained has a pH of less than 6.5.

* * * * *